US006408449B1

(12) United States Patent
Aguirre

(10) Patent No.: US 6,408,449 B1
(45) Date of Patent: Jun. 25, 2002

(54) URINAL ATTACHMENT TO A COMMODE

(76) Inventor: David Aguirre, 1004 Ave. I, Brownwood, TX (US) 76801

( * ) Notice: Subject to any disclaimer, the term of this patent is extended or adjusted under 35 U.S.C. 154(b) by 0 days.

(21) Appl. No.: 09/829,143

(22) Filed: Apr. 9, 2001

(51) Int. Cl.[7] ..... E03D 13/00
(52) U.S. Cl. ..... 4/342; 4/421
(58) Field of Search ..... 4/301, 311, 340, 4/341, 342, 421

(56) References Cited

U.S. PATENT DOCUMENTS 5,153,947 A * 10/1992 Markles ..... 4/342
5,390,374 A * 2/1995 Hubrig et al. ..... 4/301
5,575,020 A * 11/1996 Hubrig et al. ..... 4/342
6,079,057 A * 6/2000 Mette ..... 4/342

* cited by examiner

*Primary Examiner*—Robert M. Fetsuga
(74) *Attorney, Agent, or Firm*—Soules & Wallace, P.C.; Janice Leverett

(57) ABSTRACT

A toilet assembly in combination with a urinal incorporating a commode including a bowl being supported by a base and being in communication with a water tank having a flushing mechanism thereon. The base has a peripheral wall which houses a passageway located therein. A nipple is projected through the wall of the base and connects the urinal to the commode utilizing a valve connection. A guard shield is interiorly attached to the wall of the base and is in communication with the nipple in order to allow fluids to flow through the passageway.

16 Claims, 4 Drawing Sheets

URINAL ATTACHMENT TO A COMMODE

TECHNICAL FIELD

The present invention relates to plumbing fixtures; more particularly, to a urinal attachment that may be coupled or retrofitted to a toilet.

BACKGROUND OF THE INVENTION

The usage of commodes and urinals are known in the art. Generally, it has been common practice to provide a water tank incorporating a flushing device in association with a commode to help dispose of contents within a toilet bowl and down a drainpipe. The toilet bowl typically includes a seat and a lid attached thereon and is supported by a base. A base plate is normally mounted onto a floor in order to securingly support the base of the toilet. In contrast, a standard urinal includes a urinal bowl and a flushing apparatus attached to the bowl. A urinal-rinsing line is positioned within the bowl to release water through rinsing apertures. Here, when the flushing apparatus is activated, water cascades downward into the bowl and down a drain line in order to refresh the bowl for subsequent usage. However, these standard commodes and urinals, as two separate entities, have necessitated substantial special requirements and have promoted excess water utilization during the flushing processes.

With increasing need for water conservation, many devices have been introduced in order to provide a system which reduces the number of times a toilet is flushed. Such devices have been presented in the form of urinal attachments for conventional toilets. Examples of such devices are shown in U.S. Pat. Nos. 3,500,480; 3,822,419; 4,137,579; 4,180,875; 4,282,611; 4,549,321 and 4,750,219. However, most of the urinal attachments either drain directly into the toilet bowl or require a modified toilet bowl since the urinal attachments cannot be readily attached to an existing toilet bowl unit.

Several attempts have been made to redesign such combination urinal and toilet units in order to provide direct drainage from a urinal into the drain hole of a commode. An example of these devices is depicted in U.S. Pat. No. 5,153,947 issued to Markles. The '947 patent describes a urinal device having a urinal bowl that is supported adjacent to a toilet. The bowl includes an outlet drain to which an outlet drain line is connected in order to directly drain into the drain line rather than into the toilet bowl. Preferably, the urinal bowl includes a bowl-rinsing line affixed to the conventional bowl flushing and filling assembly so that whenever the toilet is flushed, the urinal bowl is rinsed.

Other attempts have focused on a urinal that is capable of being retrofitted to an existing commode. An example of such a retrofit unit is shown in U.S. Pat. No. 5,655,230 issued to Corbin. The '230 patent discloses an auxiliary urinal retrofittable to an existing commode where the urinal is connected to a base plate. Here, the base plate is placed between the base of the toilet and the floor to allow the urinal to drain liquid into a pipe used by the commode.

In view of the above described deficiencies associated with the use of conventionally designed toilet and urinal devices, the present invention has been developed to alleviate these drawbacks and provide further benefits to a vehicle. These enhancements and benefits are described in greater detail herein below with respect to several alternative embodiments of the present invention.

SUMMARY OF THE INVENTION

Disclosed herein is a toilet assembly in combination with a urinal incorporating a commode having a bowl being supported by a base and being in communication with a water tank including a flushing mechanism attached thereon. The base has a peripheral wall housing a passageway located therein. A nipple extends through the wall of the base and connects the urinal to the commode utilizing a valve connection. A guard shield is interiorly attached to the wall of the base and is in communication with the nipple in order to allow fluids to flow through the passageway. The present invention also provides for a guard shield to protect the nipple from being exposed to excretions that are disposed from the commode. Further, a holding apparatus may be mounted onto the commode and/or the urinal in order to protect various items from being damaged.

An advantage of the present invention is to increase water conservation by providing a toilet assembly in combination with a urinal which helps reduce the number of times the toilet is flushed. Specifically, when the urinal is utilized and is subsequently flushed, the disposed fluid will bypass the toilet bowl and enter into the passageway of the base of the toilet and down the drain line.

Another benefit of the present invention is to provide a urinal that is capable of being attached to an existing toilet. Once the urinal is coupled to the toilet, the urinal may be drained directly into the passageway.

The beneficial effects described above apply generally to the exemplary methods disclosed herein of the method for controlling a power source in a transporting vehicle utilizing sensed output from a driver input device. The specific methods through which these benefits are delivered will be described in detail herein below.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Furthermore, elements may be recited as being "coupled"; this terminology's use contemplates elements being connected together in such a way that there may be other components interstitially located between the specified elements, and that the elements so specified may be connected in fixed or movable relation one to the other. The term "coupled" should be contrasted with the use of the terminology "direct" connection which designates a relationship or joinder that does not have other components interstitially located therebetween, but the components may be fixed or movable with respect to one another.

Figure 1:
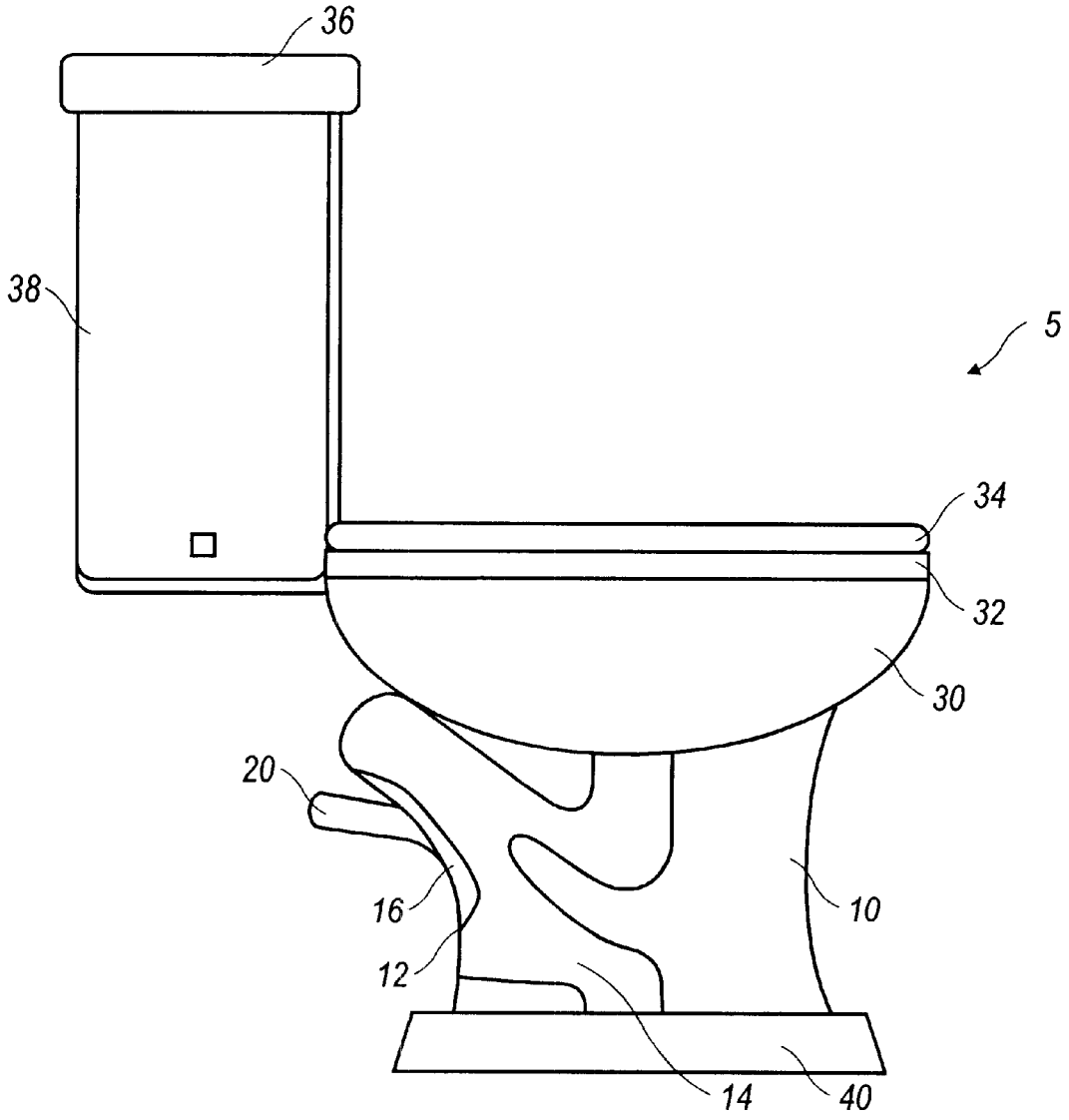
FIG. 1 illustrates a left-handed side view of a toilet assembly having a nipple coupled to a guard shield.
Figure 2:
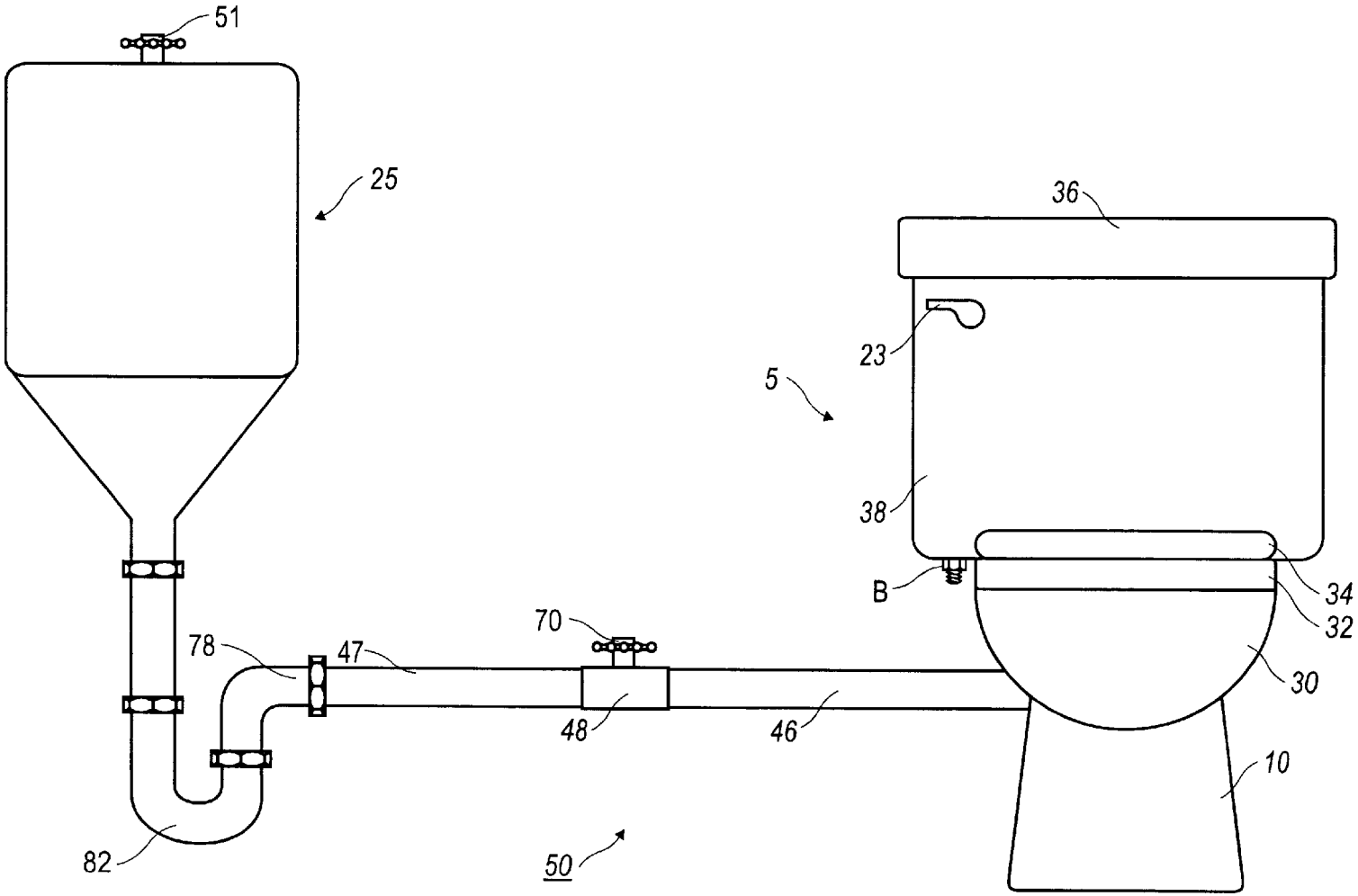
FIG. 2 is a perspective exploded view of the toilet assembly in combination with a urinal using a connector valve.
Figure 3:
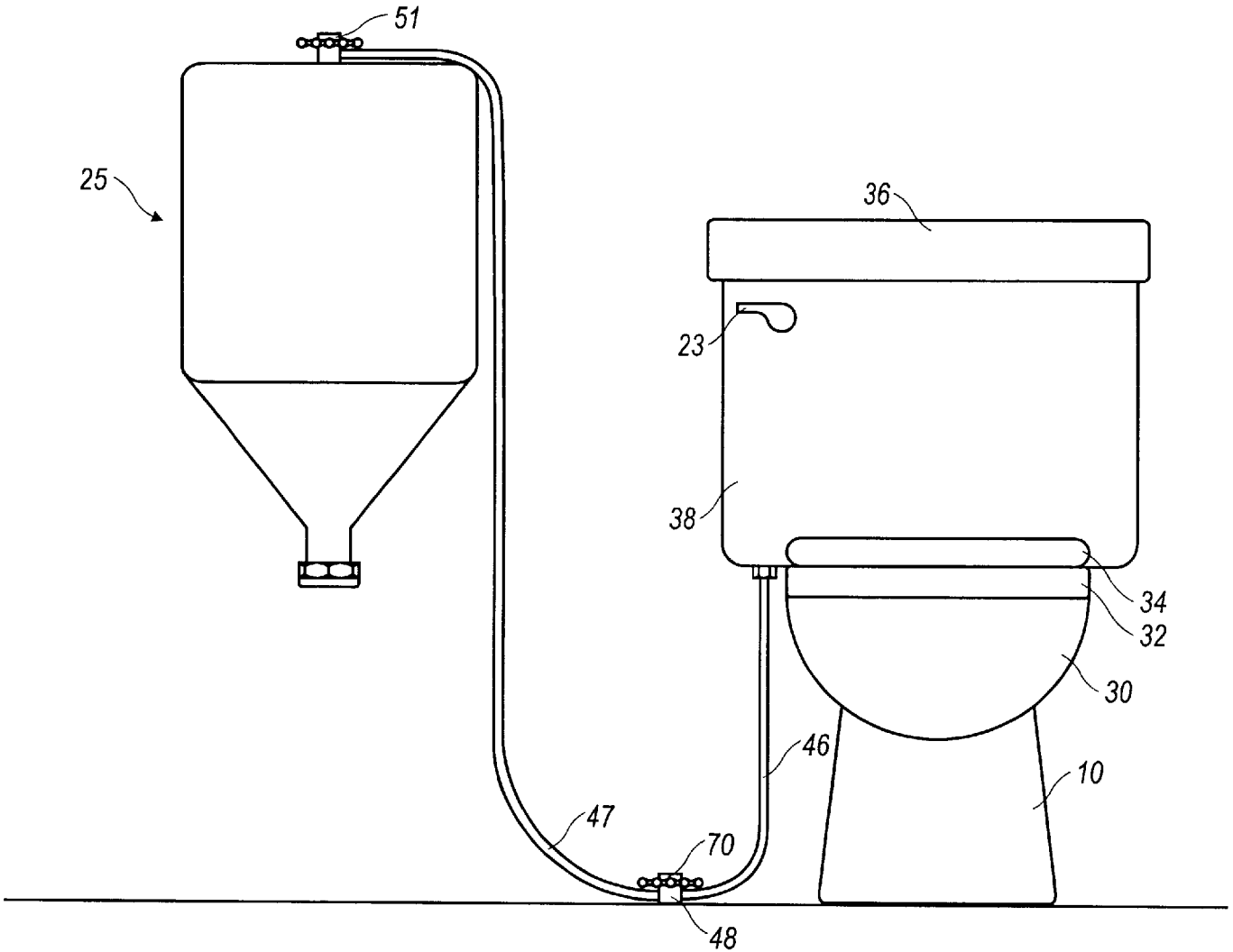
FIG. 3 is a perspective view of an alternative embodiment of the toilet assembly being coupled to the urinal.

FIGS. 2 and 3 illustrate a urinal 25 being receivingly attached to a commode 5. The commode 5, shown in FIG. 1, collectively includes a bowl 30 being in communication with a water tank 38 and being supported by a base 10. Preferably, the bowl 30 has a seat 32 and an attached lid 34 mounted thereon. The water tank 38 has a flushing mechanism 23 operatively attached thereto and a lid removably connected thereon. In a preferred embodiment, the water tank 38 may include a holding apparatus (not shown) being fixedly attached and projecting from the water tank 38. The holding apparatus (not shown) is capable of upholding contents such as hats, jackets, scarves, bags, etc. in order to prevent damage to such items. Here, the holding apparatus (not shown) may be made of plastic, rubber, ceramic or any other material durable enough to support an item.

The base 10 is mounted onto a base plate 40 and incorporates a peripheral wall 12 and a passageway 14 internally located within the peripheral wall 12. Preferably, a portion of the passageway 14 terminates at a side of the peripheral wall 12. Here, the peripheral wall 12 has a nipple 20 projecting therethrough in order to connect the urinal 25 to the commode 5 by utilizing a valve connection 50.

In a preferred embodiment, a guard shield 16 is interiorly attached to the passageway 14. Specifically, the guard shield 16 incorporates a first side, a second side and an open end. The first side of the guard shield 16 is connectively mounted inside the passageway 14 in order to receive the nipple 20 therethrough. Preferably, the nipple 20 extends into and through the first side of the guard shield 16. The second side and the open end of the guard shield 16 are housed within the passageway 14. Preferably, the second side faces the interior of the passageway 14 and the open end is positioned in a downward manner.

FIGS. 2 and 3 illustrate the commode assembly 5 being combined with the urinal 25 using a valve connection 50. Specifically in FIG. 4, the valve connection 50 incorporates a valve connector 48 having a handle 70, namely a valve ball, a first end and a second end. The first end of the valve connector 48 operatively receives an end of a first hose 46 thereto and the second end of the valve connector 48 connects an end of a second hose 47 thereto. The first and second hoses 46, 47 may also be known as pipe made of steel, plastic, copper or other durable materials. A second end of the first hose 46 may be attached to either the base 10 of the commode 5 or directly to the water tank 38. In a preferred embodiment, the second end of the first hose 46 may be coupled to one side of an elbow 72, preferably a 90° spig elbow. A second side of the elbow 72 may be inserted into a coupling 74 that is in turn attached to the commode 5.

A second end of the second hose 47 is engagingly connected to the urinal 25, preferably to either a base portion of the urinal 25 or positioned about a urinal flushing apparatus 51. In a preferred embodiment, the second end of the second hose 47 is insertably engaged to one side of a male adapter 76. A second side of the male adapter 76 is fastened to a slip joint 78 utilizing connectors (not shown) such as a nut and washers. One side of a j-trap device 82 is connected to the slip joint 78 as a second side of the j-trap 82 is inserted to the base portion of the urinal 25.

Figure 4:
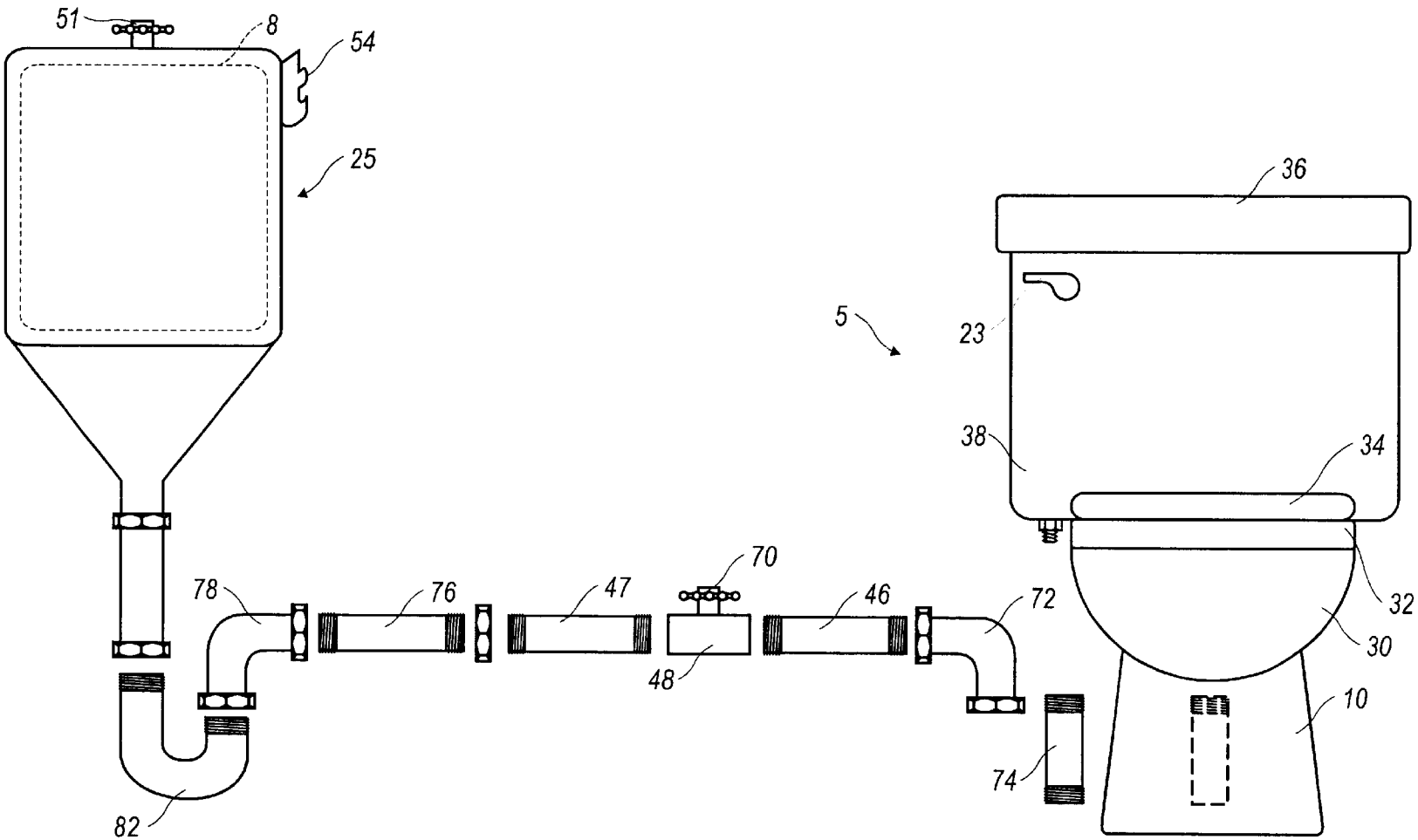
FIG. 4 shows a front exploded view of the urinal incorporating a urinal flushing apparatus and a urinal rinsing line.

Specifically, the urinal flushing apparatus 51 is preferably coupled to a top portion of the urinal 25 as seen in FIG. 3. In FIG. 4, the urinal 25 further includes a urinal rinsing line 8 preferably inwardly mounted across the top portion of the urinal 25. In a preferred embodiment, the urinal 25 may include a holding apparatus 54 extending from the urinal 25. The holding apparatus 54 is primarily designed to uphold contents such as hats, jackets, scarves, bags, etc. in order to prevent damage to such items. Here, the holding apparatus 54 may be made of plastic, rubber, ceramic or any other material durable enough to support an item.

During operation, when the urinal flushing apparatus 51 is depressed or alternatively turned, fluid held within the urinal 25 is drained through the hoses 46, 47 of the valve connection 50. The disposed fluid proceeds through the nipple 20 and downwardly flows into an open end of the guard shield 16 and into the passageway 14 for disposal. In turn, the urinal rinsing line 8 releases a predetermined amount of water in order to refresh the urinal 25. Alternately, when the flushing mechanism 23 of the commode 5 is depressed, fluid and contents being held within the bowl 30 are disposed down the passageway 14 allowing excretions to flow therethrough. Here, the guard shield 16 protects the nipple 20 from damage during the commode 5 disposal process.

INDUSTRIAL APPLICABILITY

The present invention finds specific industrial applicability in the plumbing fixtures and home improvement industries.

What is claimed and desired to be secured by Letters Patent is as follows:

1. A toilet assembly in combination with a urinal comprising:

a commode having a bowl being in communication with a water tank and being supported by a base;

a flushing mechanism attached to said water tank;

said base having a peripheral wall and a passageway located inside said wall;

a nipple being projected through said wall of said base; and said nipple connecting said urinal to said commode utilizing a valve connection.

2. The toilet assembly in combination with a urinal as recited in claim 1, further comprising:

a guard shield having a first side, a second side and an open end, wherein said guard shield is interiorly attached to said wall of said base.

3. The toilet assembly in combination with a urinal as recited in claim 2, wherein said nipple extends into and through said first side of said guard shield.

4. The toilet assembly in combination with a urinal as recited in claim 2, wherein said flushing mechanism is depressed communicating with said water tank to release fluid into said bowl and down said passageway allowing excretions to flow through said passageway.

5. The toilet assembly in combination with a urinal as recited in claim 1, further comprising:

a urinal flushing apparatus connected to said urinal; and a urinal rinsing line inwardly mounted across an upper end of said urinal.

6. The toilet assembly in combination with a urinal as recited in claim 5, wherein said urinal flushing apparatus is depressed yielding fluid being drained through said nipple and into said guard shield.

7. The toilet assembly in combination with a urinal as recited in claim 6, wherein said nipple terminates within said guard shield allowing fluid to downwardly flow into an open end of said guard shield and into said passageway.

8. The toilet assembly in combination with a urinal as recited in claim 1, further comprising a holding apparatus being fixedly attached to said water tank.

9. The toilet assembly in combination with a urinal as recited in claim 8, wherein said seat has an attached lid.

10. The toilet assembly in combination with a urinal as recited in claim 1, further comprising a holding apparatus connected to said urinal.

11. The toilet assembly in combination with a urinal as recited in claim 1, wherein said valve connection having a valve connector operatively receiving a first hose and a second hose; said first hose being attached to said base of said commode and said second hose being connected to said urinal.

12. The toilet assembly in combination with a urinal as recited in claim 11, wherein said valve connector having a handle, a first end and a second end; said first end connects said first hose thereto and said second end receives said second hose.

13. The toilet assembly in combination with a urinal as recited in claim 1, wherein said tank has a lid.

14. The toilet assembly in combination with a urinal as recited in claim 1, wherein said bowl has a seat.

15. The toilet assembly in combination with a urinal as recited in claim 1, wherein said bowl has a lid.

16. The toilet assembly in combination with a urinal as recited in claim 1, wherein said base is mounted on a base plate.

* * * * *